US009771190B2

(12) United States Patent
Piscopo

(10) Patent No.: US 9,771,190 B2
(45) Date of Patent: Sep. 26, 2017

(54) CHILD-RESISTANT CLOSURE

(71) Applicant: Plastek Industries, Inc., Erie, PA (US)

(72) Inventor: Peter A. Piscopo, Medford, NJ (US)

(73) Assignee: Plastek Industries, Inc., Erie, PA (US)

( * ) Notice: Subject to any disclaimer, the term of this patent is extended or adjusted under 35 U.S.C. 154(b) by 0 days.

(21) Appl. No.: 15/079,765

(22) Filed: Mar. 24, 2016

(65) Prior Publication Data

US 2016/0297579 A1 Oct. 13, 2016

Related U.S. Application Data

(60) Provisional application No. 62/145,202, filed on Apr. 9, 2015.

(51) Int. Cl.
*B65D 50/04* (2006.01)

(52) U.S. Cl.
CPC ..... *B65D 50/046* (2013.01)

(58) Field of Classification Search
CPC .... B65D 50/046; B65D 50/045; B65D 50/04; B65D 50/061; B65D 51/245; B65D 41/0471; B65D 41/04; B65D 41/06; B65D 43/0229
USPC ..... 215/216, 221, 218, 217, 206, 230, 331, 215/330, 329, 316, 201; 220/298, 300, 220/302, 301, 293, 288, 262, 281
See application file for complete search history.

(56) References Cited

U.S. PATENT DOCUMENTS 5,671,853 A 9/1997 Herr
5,687,863 A * 11/1997 Kusz ..... B65D 41/0471 215/216
5,865,330 A 2/1999 Buono
5,908,125 A 6/1999 Opresco
5,915,576 A 6/1999 Robinson
5,921,417 A 7/1999 Mull
(Continued)

FOREIGN PATENT DOCUMENTS

EP 1357049 A2 10/2003
WO 97/16358 A1 5/1997
(Continued)

OTHER PUBLICATIONS

Applicant Admitted Prior Art: photos of generic atorvastatin containers, Mar. 18, 2015.

*Primary Examiner* — Robert J Hicks
(74) *Attorney, Agent, or Firm* — Bachman & LaPointe, P.C.

(57) ABSTRACT

A child-resistant container cap has: an internally threaded inner sidewall. An outer sidewall surrounds the inner wall and has a cross-section normal to the central axis characterized by an opposite first pair of ends compressable from a relaxed condition to a compressed condition and an opposite second pair of ends, a direction between the second pair of ends being normal to a direction between the first pair of ends. A pair of engagement features are carried by the outer sidewall and engagable with container body engagement features to prevent an unscrewing rotation with the cap in the installed condition and the outer sidewall relaxed. Compression of the first ends from the relaxed condition to the compressed condition shifts the cap engagement features radially outward to permit the unscrewing rotation. The cross-section of the cap is longer between the first ends than the second ends.

15 Claims, 5 Drawing Sheets

(56) References Cited

U.S. PATENT DOCUMENTS

| | | | |
|---|---|---|---|
| 5,927,526 | A | 7/1999 | Herr |
| 6,112,779 | A | 9/2000 | Camilla |
| 6,112,921 | A | 9/2000 | Robinson |
| 6,161,711 | A | 12/2000 | Miceli et al. |
| 6,168,035 | B1 | 1/2001 | McLelland |
| 6,296,130 | B1 | 10/2001 | Forsyth et al. |
| 6,357,615 | B1 | 3/2002 | Herr |
| 6,783,014 | B2 | 8/2004 | Luker |
| 6,866,164 | B2 | 3/2005 | Branson et al. |
| 6,988,642 | B2 | 1/2006 | Gallo et al. |
| 7,097,058 | B2 | 8/2006 | Wellman et al. |
| 7,111,746 | B2 | 9/2006 | Miceli et al. |
| 7,334,694 | B2 | 2/2008 | Suffa |
| 7,628,283 | B2 | 12/2009 | Shingle |
| 7,628,298 | B2 | 12/2009 | Dewig et al. |
| 7,641,064 | B2 | 1/2010 | Robinson |
| 7,731,048 | B2 | 6/2010 | Alvares et al. |
| 7,815,062 | B2 | 10/2010 | Suffa |
| 7,828,166 | B1 | 11/2010 | Sprick |
| 7,861,873 | B1 | 1/2011 | Bragg et al. |
| 8,051,999 | B2 | 11/2011 | Carmody et al. |
| 8,079,483 | B2 | 12/2011 | Brozell et al. |
| 8,123,058 | B2 | 2/2012 | Brozell et al. |
| 8,240,491 | B2 | 8/2012 | Beecroft et al. |
| 8,245,867 | B2 | 8/2012 | Allen |
| 8,292,101 | B1 | 10/2012 | Bragg et al. |
| 8,371,463 | B2 | 2/2013 | Beecroft |
| 2005/0205607 | A1* | 9/2005 | Hierzer |
| 2009/0223985 | A1* | 9/2009 | Carmody ..... B65D 41/0471 220/780 |
| 2010/0025355 | A1* | 2/2010 | Beecroft ..... B65D 50/046 215/216 |
| 2012/0000879 | A1 | 1/2012 | McFarlane et al. |
| 2013/0097973 | A1* | 4/2013 | McCoy ..... B65D 1/02 53/467 |
| 2015/0129531 | A1* | 5/2015 | Gatton |
| 2016/0159533 | A1* | 6/2016 | Piscopo ..... B65D 50/041 53/490 |

FOREIGN PATENT DOCUMENTS

| | | | |
|---|---|---|---|
| WO | 98/50157 | A1 | 11/1998 |
| WO | 00/06454 | A1 | 2/2000 |
| WO | 2004/103877 | A1 | 12/2004 |
| WO | 2006/044003 | A1 | 4/2006 |
| WO | 2008/141163 | A1 | 11/2008 |

* cited by examiner

CHILD-RESISTANT CLOSURE

CROSS-REFERENCE TO RELATED APPLICATION

Benefit is claimed of U.S. Patent Application No. 62/145,202, filed Apr. 9, 2015, and entitled "Child-Resistant Closure", the disclosure of which is incorporated by reference herein in its entirety as if set forth at length.

BACKGROUND OF THE INVENTION

The invention relates to screw-on container closures. More particularly, the invention relates to child-resistant closures.

Among numerous examples of child-resistant closures for small over-the-counter (OTC) medications (e.g., pills, capsules, tablets) is U.S. Pat. No. 5,671,853 of Herr, issued Sep. 30, 1997.

SUMMARY OF THE INVENTION

One aspect of the disclosure involves a child-resistant container system comprising a container body and a cap. The container body has: a sidewall; a mouth; an externally-threaded neck between the mouth and the body; and a pair of engagement features. The cap has: an internally threaded inner sidewall matable to the externally-threaded neck in an installed condition and unscrewable from the externally-threaded neck to a removed condition. An outer sidewall surrounds the inner wall and has a cross-section normal to the axis characterized by an opposite first pair of ends compressable from a relaxed condition to a compressed condition and an opposite second pair of ends, a direction between the second pair of ends being normal to a direction between the first pair of ends. A pair of engagement features are carried by the outer wall and engagable with the container body engagement features to prevent an unscrewing rotation with the cap in the installed condition and the outer sidewall in the relaxed condition. Compression of the first ends from the relaxed condition to the compressed condition shifts the cap engagement features radially outward to permit the unscrewing rotation from the installed condition. The cross-section of the cap is longer in a direction between the first ends than in a direction between the second ends.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
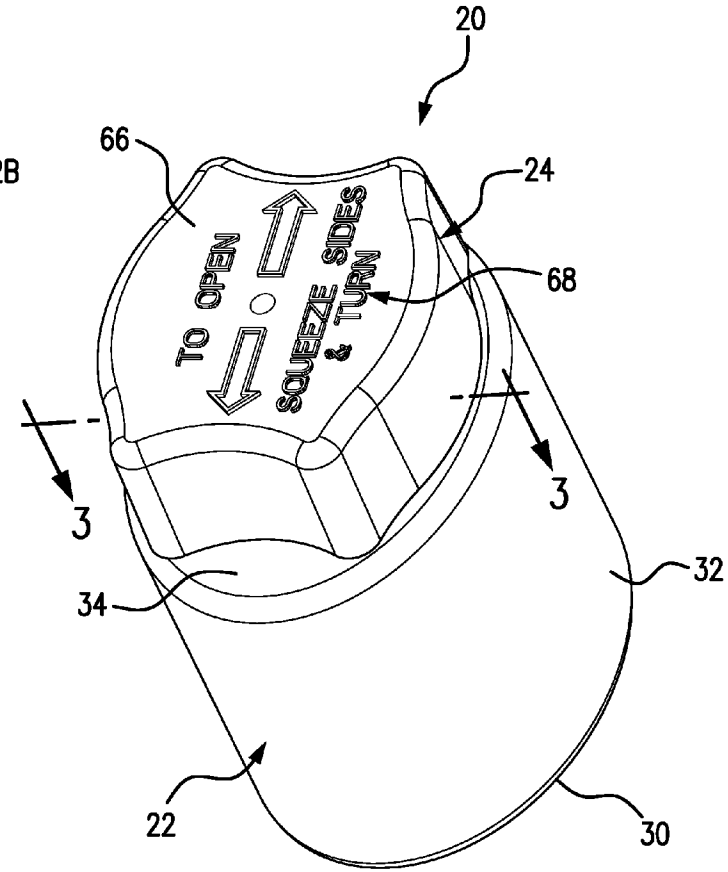
FIG. 1 is a top oblique view of a child-resistant container.
Figure 2:
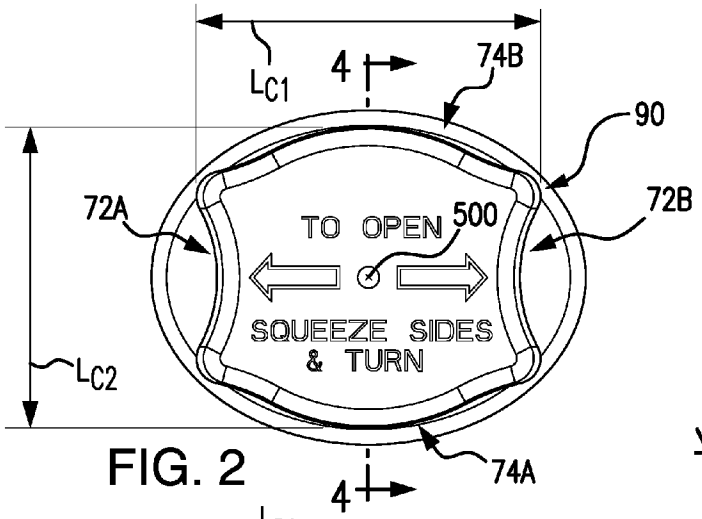
FIG. 2 is a top view of the container of FIG. 1.
Figure 5:
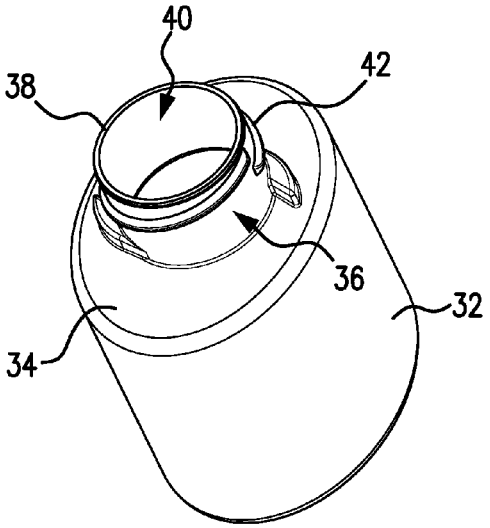
FIG. 5 is a top oblique view of a body of the container of FIG. 1.
Figure 7:
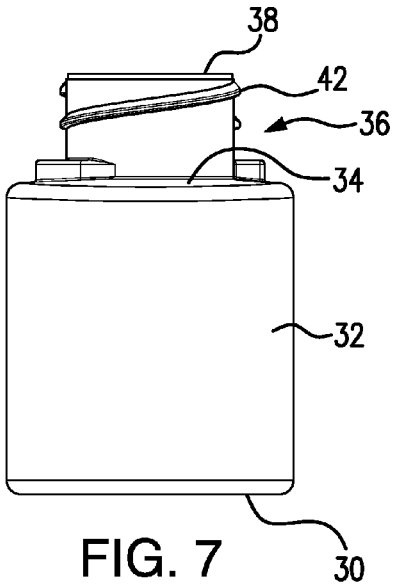
FIG. 7 is a side view of the body of FIG. 5.
Figure 6:
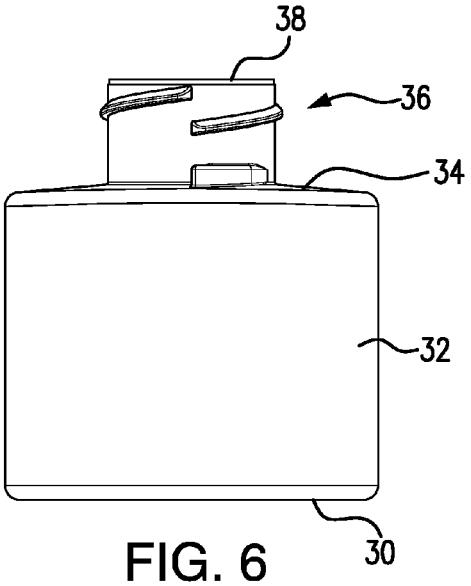
FIG. 6 is a front view of the body of FIG. 5.
Figure 9A:
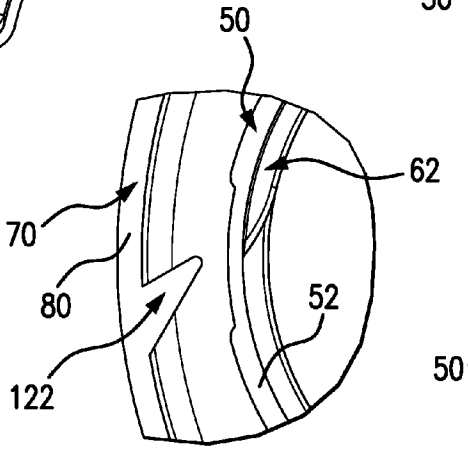
FIG. 9A is an enlarged view of an engagement feature of the closure of FIG. 9.
Figure 9:
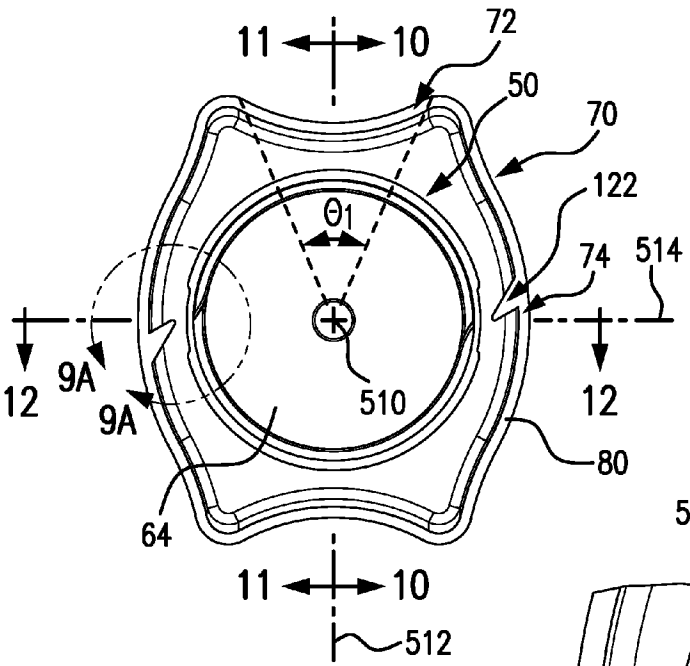
FIG. 9 is a bottom view of a closure of the container.

FIG. 1 shows a container 20 comprising a container body 22 and a cap or closure 24. The exemplary container body is a molded plastic single-piece member (e.g., roto-molded or blow molded or injection molded). The exemplary body has a base 30, a sidewall 32 extending upward from the base, a shoulder 34 extending upward from the sidewall, and a neck 36 (FIG. 5) extending upward from the shoulder and extending to a rim 38 to define a body opening or mouth 40 (FIG. 9). The neck bears an external thread 42 for engaging an internal thread of the closure. The neck defines a central longitudinal/vertical axis 500 (FIG. 2). The exemplary thread 42 is a double lead thread providing evenness/straightness of screwing and unscrewing.

The exemplary closure 24 is a one-piece closure. An exemplary closure piece is molded plastic (e.g., injection molded). Exemplary plastics are polyolefins such as polypropylenes and polyethylenes. The closure may comprise an additional member such as an elastomeric or paper seal or gasket, safety seal, or the like.

Figure 4:
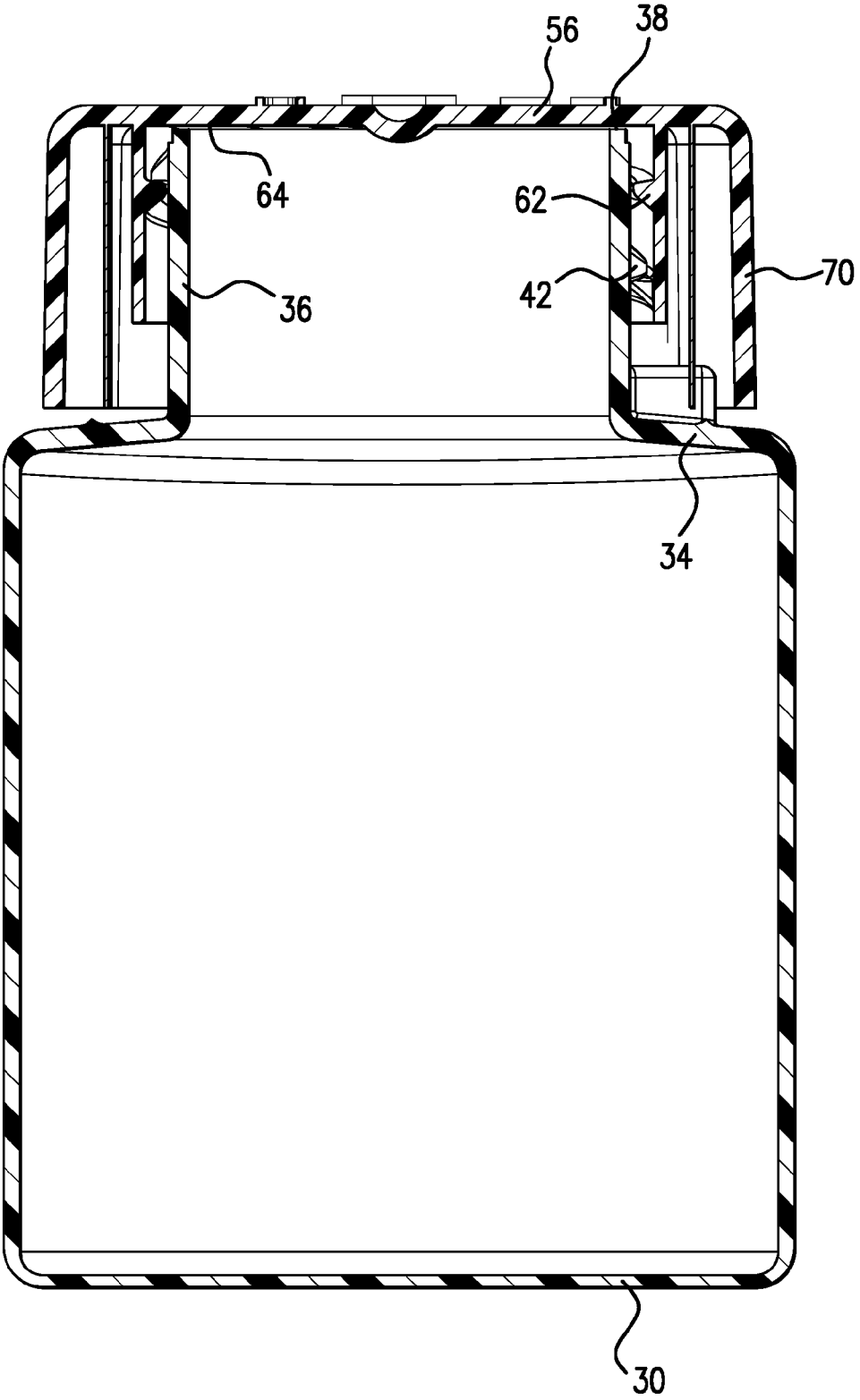
FIG. 4 is a central vertical sectional view of the container taken along line 4-4 of FIG. 2.

FIGS. 9-12 show the exemplary closure as comprising an inner sidewall 50 extending upward from a lower end formed by a rim 52 to an upper end 54 merging with a transverse web 56 closing the upper end. The inner sidewall 50 has an inboard or inner diameter (ID) surface 58 and an outboard or outer diameter (OD) surface 60. The ID surface 58 bears an internal thread 62 complementary to the external thread of the neck. In the fully installed condition, the underside 64 of the web inboard of the ID surface 58 may seal against the rim 38 or be in close facing proximity thereto (FIG. 4). FIG. 9 shows an underside 64 of the web and FIG. 1 shows an upper surface 66 of the web. The upper surface may have, pre-molded thereto, instructional indicia 68.

The closure further comprises an outer sidewall 70 (FIG. 9). As is discussed further below, the outer sidewall 70 has an exemplary four distinct portions with a first pair of opposed portions (FIG. 2) being gripping portions 72A, 72B (collectively or individually 72) and a second pair of opposed portions 74A, 74B (collectively or individually 74; orthogonal to the first pair). The portions 72 are gripping/release portions for gripping by the user to release child-resistance features to allow an unscrewing rotation of the closure.

The exemplary body 22 and closure 24 have transversely elongate footprints. The exemplary body footprint (FIG. 3) is approximately elliptical with a major axis $L_{B1}$ and a minor axis $L_{B2}$. Exemplary $L_{B1}$ is about 125% of $L_{B2}$, more broadly, at least 110% or at least 115% or at least 120%. Exemplary upper limits pairable with any of those lower limits are 130% or 140% or 150% or 200%.

Figure 8:
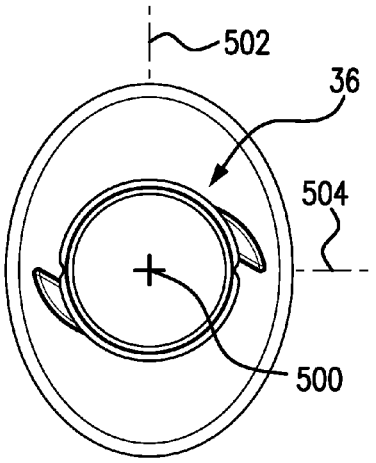
FIG. 8 is a top view of the body of FIG. 5.
Figure 10:
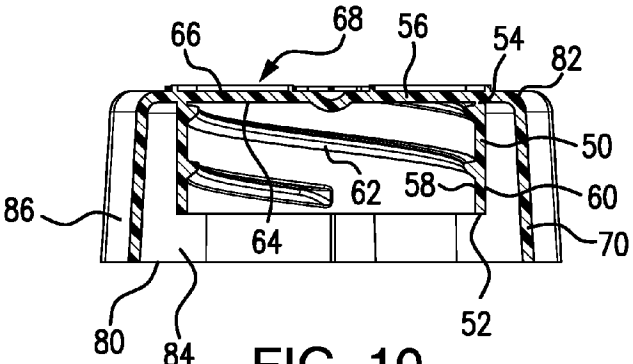
FIG. 10 is a central vertical sectional view of the closure taken along line 10-10 of FIG. 9.
Figure 11:
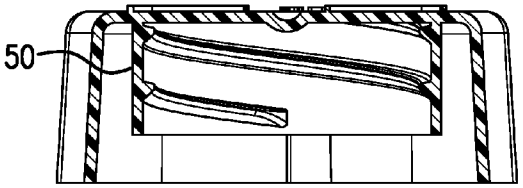
FIG. 11 is a central vertical sectional view of the closure taken alone line 11-11 of FIG. 9.
Figure 12:
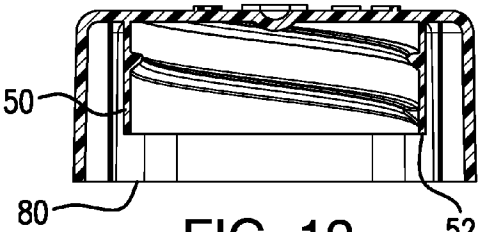
FIG. 12 is a central vertical sectional view of the closure taken alone line 12-12 of FIG. 9.

To define frames of reference, for such a generally symmetric container, the neck central longitudinal axis 500 defines central longitudinal axis of the body 22 which is vertical in a normal storage position. With the transverse elongate footprint, a plane 502 (FIG. 8) through the body containing the axis 500 is defined as a lateral or transverse longitudinal side-to-side plane; and a plane 504 containing the axis 500 and normal to the plane 502 is a central longitudinal sagittal (front-to-back) plane. Thus, the major axis of the ellipse falls along the plane 502 and the minor axis of the ellipse falls along the plane 504. In the exemplary fully screwed on/installed condition, planes of the closure are similar thereto. For ease of reference, the closure 24 central longitudinal axis is shown as 510 (FIG. 9); the closure transverse longitudinal centerplane is shown as 512; and the closure sagittal longitudinal centerplane is shown as 514. In the illustrated installed condition, 510 is coincident with 500, 512 coincident with 502, and 514 coincident with 504.

The exemplary closure 24 footprint is, however, not elliptical. Rather, along what would have been the major axis of the ellipse footprint, end portions of the footprint are concave outward rather than convex outward to form the portions 72. As is discussed below, this helps gripping. The concavity may mean that actual cross-section/footprint length at the centerplane 512 is about the same as that at the centerplane 514. Overall footprint or cross-section length $L_{C1}$ (FIG. 2) in that direction (parallel to plane 512) may still be longer than overall length $L_{C2}$ transverse or normal thereto due to protrusion of transitions 90 (discussed below). Exemplary $L_{C1}$ is at least 105% of $L_{C2}$ or at least 110%. Upper limits may be similar to those of the body elongatedness, particularly if the concavities are not present.

Figure 13:
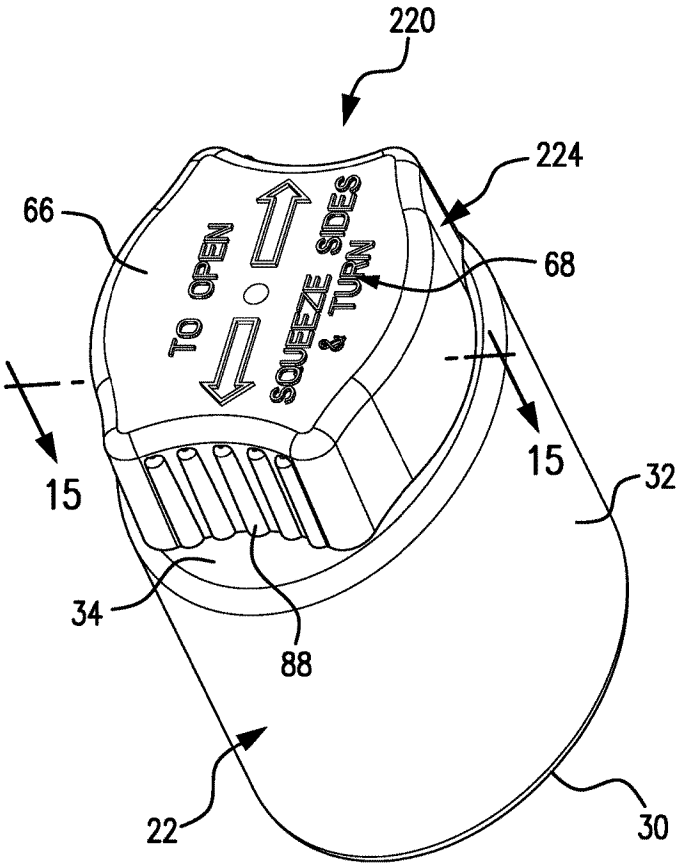
FIG. 13 is a top oblique view of a second embodiment of a child-resistant container.
Figure 14:
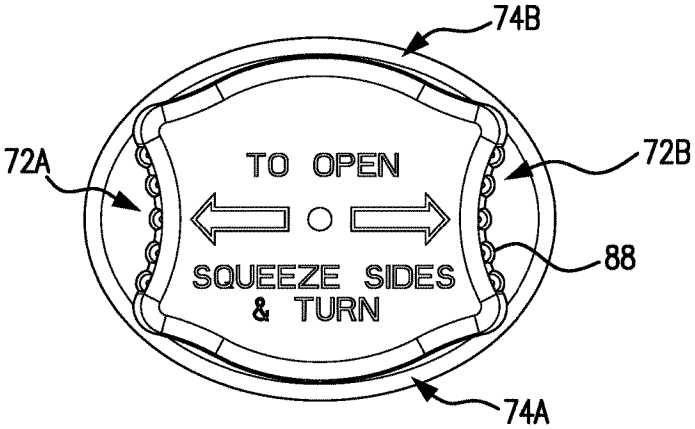
FIG. 14 is a top view of the container of FIG. 13.
Figure 15:
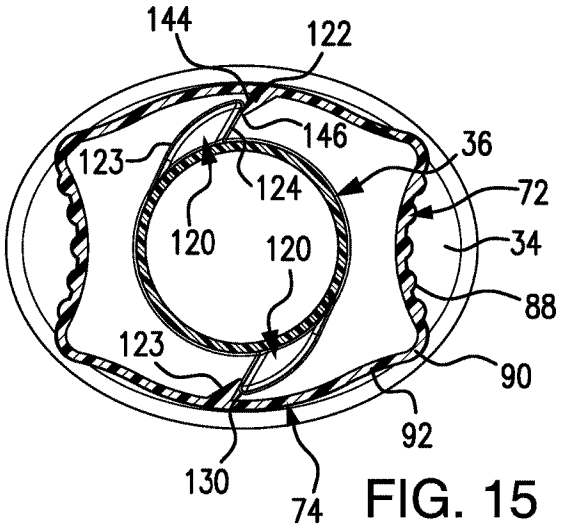
FIG. 15 is a transverse sectional view of the container taken along line 15-15 of FIG. 13.

The closure outer sidewall 70 extends from a lower rim 80 (FIG. 10) to an upper end 82. The upper end 82 merges with a periphery of the web 56. The outer sidewall 70 has an inboard or inner diameter (ID) surface 84 and an outboard or outer diameter (OD) surface 86. Along the gripping portions 72, the exemplary surface 86 optionally bears a series of lands 88 (FIG. 13 for modified closure 224 of the container 220) and grooves or other contouring to facilitate gripping.

Figure 3:
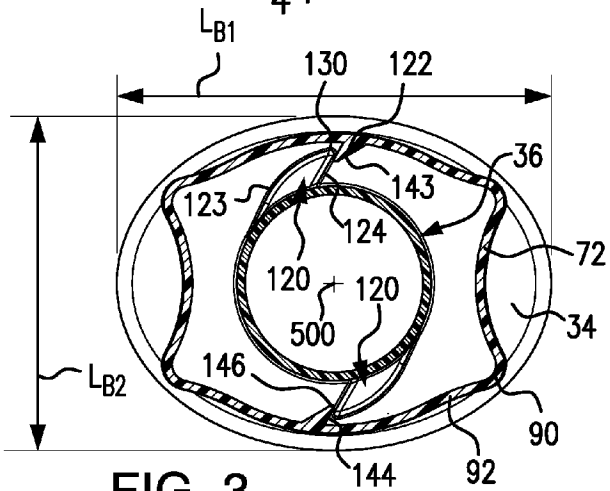
FIG. 3 is a transverse sectional view of the container taken along line 3-3 of FIG. 1.

FIG. 3 shows the general outward concavity and inward convexity of the gripping portions 72. FIG. 3 also shows the portions 74 transverse thereto being, along majority central portions thereof, convex outward and concave inward. Transitions between adjacent edges of the portions 72 and 74 are formed by convex outward/concave inward transitions 90. In the exemplary embodiment, however, between the transitions 90 and the central portions of the sidewall portions 74, there are further transitions 92 that are outwardly concave and inwardly convex.

FIG. 9 shows the outwardly concave region of gripping portion 72 as extending for an angle $\theta_1$ about the axis 510. Exemplary $\theta_1$ is at least 20°, more narrowly, at least 30°, or an exemplary 30°-60°.

As is discussed further below, the body and closure have two pairs of engagement features 120, 122 (FIG. 3) cooperating with each other. The engagement features allow the closure to be rotated about the axis 500 in a direction to install the closure (i.e., screw the closure onto the body) but normally block the opposite unscrewing/removal rotation. The engagement features may be manipulated to allow the closure to be rotated in an opposite unscrewing/removal rotation. The manipulation involves inwardly compressing the gripping portions 72. This manipulation may require application of sufficient force/pressure or manipulation to qualify as a child-resistant action. Absent the manipulation, unscrewing rotation is blocked by the engagement features.

The exemplary engagement features 120 (FIG. 3) are formed by a pair of ramps extending radially outward from the neck 36 along the shoulder 34 diametrically opposite each other. The ramps have a first circumferential surface or face 123 and opposite second circumferential surface or face 124. The surfaces 123 and 124 may also meet at an apex region 130.

As is discussed further below, the surfaces 123 are ramp surfaces and the surfaces 124 are stop surfaces. The surfaces 124 are relatively radial or over-radial so as to cooperate with complementary surfaces of the closure engagement features 122 to resist unscrewing motion absent the aforementioned manipulation. The surfaces 123 allow the closure engagement features to override in a screwing/installing rotation as is discussed further below.

FIG. 3 shows further details of the features 122. The exemplary features 122 are formed by a pair of barbs or ramps extending radially inward from the outer sidewall inboard surface along the respective portions 74 diametrically opposite each other. As is discussed below, the features have circumferential surfaces 143 and 144 (which may meet at or be joined by an apex or junction region 146). The surfaces 143 may be angled in complementary fashion to the surfaces 123 so that they override each other (discussed below) during an installing rotation.

The surfaces 144 and 124 are sufficiently complementary to provide an opposite cooperation. During an attempt at unscrewing engagement without proper actuation, the surfaces 124 and 144 of adjacent projections abut and do not override FIG. 3 shows an installed or screwed-on condition wherein the ends or surfaces 144 are in abutting engagement with the surfaces 124 to prevent/block an unscrewing rotation of the closure about the axis 500. It is seen that the surfaces 144 are sufficiently radial or over-radial to provide the aforementioned interlocking action. Specifically, by being over-radial they are angled off-radial so that an unscrewing rotation causing contact between the surfaces 144 and 124 will drive the projections 122 radially inward into securer engagement perhaps ultimately abutting the apex regions 130 against the inner surface of the outer sidewall.

However, for unscrewing, the portions 72 may be squeezed inward (i.e., compressed inwardly toward each other and toward the plane 514). This compressing and inward shift causes a corresponding flexing of the portions 74 radially outward and shifting the closure projections 122 radially outboard of the body projections 120. In this condition, while maintaining compression between the portions 72, the closure may be unscrewed via an unscrewing rotation about the axis 500 with the each of the features 122 passing radially outboard and circumferentially past the features 120.

The heights (parallel to axis 500) of the projections 120 may be merely sufficient to provide sufficient strength for a desired resistance to opening. In the exemplary embodiment, they only have potential engagement with the projections 122 for a small portion of a single turn. With the exemplary thread, full removal can occur in one full turn.

In an installing rotation, one need not squeeze the portions 72. Instead, the junction regions 146 will engage the ramping surface 123 (and/or a curving transition to the apex region 130). The angling of the meeting surfaces is sufficient to flex the closure (e.g., radially outwardly flex the portions 74) to permit an overriding return to the installed condition.

The elongate cross-section may provide one or more of several advantages in use. First, compressing the long direction may be counterintuitive for a child. Particularly, a small child with small hands would tend to grasp across the portions 74 and compress them toward each other preventing unscrewing. Larger adult hands may be more amenable to compressing the portions 72. This is particularly the case when there are written instructions on the closure or where the optional gripping features such as lands 88 are located along the end portions 72. Also, the concavity of the portions 72, however, assists in gripping by a user with sufficiently large hands. Accordingly, this may be regarded as particularly useful for users with arthritis or other grip-related disability. However, the elongate nature of the body footprint allows easy intuitive gripping with the off hand. Thus less grip strength is required of the off hand on the body than with a round footprint body. Also, the elongate nature of the footprint of the closure allows for a greater amount of compression between the portions 72 than what may be found with corresponding portions of a circular outer sidewall close to the inner sidewall. This greater possible stroke may allow for lower compression forces.

One or more embodiments of the present invention have been described. Nevertheless, it will be understood that various modifications may be made without departing from the spirit and scope of the invention. For example, desirability of reusing existing molding and/or capping equipment may influence particular implementations. Accordingly, other embodiments are within the scope of the following claims.

What is claimed is:

1. A child-resistant container system (20) comprising:
a container body (22) having:
a sidewall (32);
a mouth (40);
an externally-threaded neck (36) between the mouth and the body; and
a pair of engagement features (120); and
a cap (24) comprising:
an internally threaded inner sidewall (52) matable to the externally-threaded neck in an installed condition and unscrewable about an axis from the externally-threaded neck to a removed condition;
an outer sidewall (70) surrounding the inner wall and having a cross-section normal to the axis characterized by an opposite first pair (72) of ends (72A, 72B) compressable from a relaxed condition to a compressed condition and an opposite second pair (74) of ends (74A, 74B), a direction between the second pair of ends being normal to a direction between the first pair of ends; and
a pair of engagement features (122) carried by the outer wall and engagable with the container body engagement features to prevent an unscrewing rotation with the cap in the installed condition and the outer sidewall in the relaxed condition,
wherein:
compression of the first ends from the relaxed condition to the compressed condition shifts the cap engagement features radially outward to permit the unscrewing rotation from the installed condition;
the cross-section of the cap is longer in a direction between the first ends than in a direction between the second ends; and
the sidewall has concave features extending along at least the first pair of ends that aid in gripping.

2. The child-resistant container system of claim 1 wherein:
the container body has an elongate footprint with a larger dimension at least 115% of a smaller dimension.

3. The child-resistant container system of claim 2 wherein:
the installed condition is a fully installed condition in which the larger dimension of the container body elongate footprint is aligned with the direction between the first ends.

4. The child-resistant container system of claim 1 wherein:
the cross-section of the cap is at least 5% longer in the direction between the first ends than in the direction between the second ends.

5. The child-resistant container system of claim 1 wherein:
the concave features extend to a lower rim of the outer sidewall.

6. The child-resistant container system of claim 5 wherein the concave features each comprise:
an outwardly concave and inwardly convex section of the outer wall extending at least 20° around a central axis (510) of the cap.

7. A method for using the container of claim 1, the method comprising:
inwardly compressing the first ends from the relaxed condition to the compressed condition shifts the cap engagement features radially outward to permit the unscrewing rotation; and
rotating the cap while holding the first ends compressed so that the cap engagement features pass by the bottle engagement features.

8. The method of claim 7 further comprising:
further rotating the cap to allow removal of the cap.

9. A method for assembling the container of claim 1, the method comprising:
rotating the cap in a threading direction, the rotating causing a camming engagement between the cap engagement features and the bottle engagement features to outwardly flex the second ends.

10. A child-resistant container system (20) comprising:
a container body (22) having:
a sidewall (32);
a mouth (40);
an externally-threaded neck (36) between the mouth and the body; and
a pair of engagement features (120); and
a cap (24) comprising:
an internally threaded inner sidewall (52) matable to the externally-threaded neck in an installed condition and unscrewable about an axis from the externally-threaded neck to a removed condition;
an outer sidewall (70) surrounding the inner wall and having a cross-section normal to the axis characterized by an opposite first pair (72) of ends (72A, 72B) compressable from a relaxed condition to a compressed condition and an opposite second pair (74) of ends (74A, 74B), a direction between the second pair of ends being normal to a direction between the first pair of ends; and
a pair of engagement features (122) carried by the outer wall and engagable with the container body engagement features to prevent an unscrewing rotation with the cap in the installed condition and the outer sidewall in the relaxed condition,
wherein:

compression of the first ends from the relaxed condition to the compressed condition shifts the cap engagement features radially outward to permit the unscrewing rotation from the installed condition; and the cap further comprises concave features extending along at least the first pair of ends that aid in gripping.

11. The child-resistant container system of claim 10 wherein the concave features each comprise:

an outwardly concave and inwardly convex section of the outer wall extending at least 20° around a central axis (510) of the cap.

12. The child-resistant container system of claim 10 further comprising gripping ribs along the concave features.

13. The child-resistant container system of claim 10 wherein the concave features extend to a lower rim of the outer sidewall.

14. The child-resistant container system of claim 10 wherein convex outward and concave inward transitions (90) transition between adjacent edges of the first pair (72) of ends (72A, 72B) and the opposite second pair (74) of ends (74A, 74B).

15. The child-resistant container system of claim 14, wherein the transitions wherein the transitions protrude to aid in gripping.

* * * * *